US008973667B2

(12) United States Patent
Hedrick

(10) Patent No.: US 8,973,667 B2
(45) Date of Patent: Mar. 10, 2015

(54) PACKING ELEMENT WITH FULL MECHANICAL CIRCUMFERENTIAL SUPPORT

(75) Inventor: Marcelle H. Hedrick, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 613 days.

(21) Appl. No.: 13/353,104

(22) Filed: Jan. 18, 2012

(65) Prior Publication Data

US 2013/0180734 A1 Jul. 18, 2013

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)
USPC ..... 166/387

(58) Field of Classification Search
CPC ... E21B 33/1208; E21B 33/128; E21B 33/12; E21B 23/06; E21B 23/01; E21B 43/103
USPC ..... 166/196, 387, 118, 206, 123, 134, 138, 166/179; 277/338
See application file for complete search history.

(56) References Cited

U.S. PATENT DOCUMENTS

| | | | | |
|---|---|---|---|---|
| 3,028,915 | A * | 4/1962 | Jennings | 166/277 |
| 3,529,667 | A * | 9/1970 | Malone | 166/387 |
| 3,776,307 | A * | 12/1973 | Young | 166/125 |
| 4,515,213 | A * | 5/1985 | Rogen et al. | 166/123 |
| 4,830,103 | A * | 5/1989 | Blackwell et al. | 166/387 |
| 5,297,633 | A * | 3/1994 | Snider et al. | 166/387 |
| 5,327,962 | A * | 7/1994 | Head | 277/334 |
| 5,511,620 | A * | 4/1996 | Baugh et al. | 166/387 |
| 5,743,333 | A * | 4/1998 | Willauer et al. | 166/122 |
| 7,549,469 | B2 * | 6/2009 | Garcia | 166/206 |
| 7,798,225 | B2 * | 9/2010 | Giroux et al. | 166/285 |
| 7,849,930 | B2 * | 12/2010 | Chalker et al. | 166/387 |
| 8,464,800 | B2 * | 6/2013 | Nutley et al. | 166/387 |
| 8,727,027 | B2 * | 5/2014 | Schilte et al. | 166/387 |
| 2002/0070503 | A1 * | 6/2002 | Zimmerman et al. | 277/337 |
| 2003/0155118 | A1 * | 8/2003 | Sonnier et al. | 166/206 |
| 2005/0161213 | A1 * | 7/2005 | Sonnier et al. | 166/207 |
| 2009/0139732 | A1 * | 6/2009 | Garcia | 166/382 |
| 2010/0126714 | A1 * | 5/2010 | Ostevik | 166/192 |
| 2013/0180734 | A1 * | 7/2013 | Hedrick | 166/387 |

FOREIGN PATENT DOCUMENTS

| | | | | |
|---|---|---|---|---|
| GB | 2366581 | A * | 3/2002 | E21B 43/08 |

* cited by examiner

*Primary Examiner* — Daniel P Stephenson
(74) *Attorney, Agent, or Firm* — Shawn Hunter

(57) ABSTRACT

A packer device for forming a fluid seal between an inner tubular member and an outer tubular member. The packer device includes a swage assembly that is expandable from a reduced diameter condition to an expanded diameter condition and a substantially deformable packer element for contacting and forming a fluid seal against a surrounding tubular. The packer element radially surrounds the swage assembly and being moved outwardly into a sealing configuration when the swage assembly is moved to its expanded diameter condition.

17 Claims, 7 Drawing Sheets

PACKING ELEMENT WITH FULL MECHANICAL CIRCUMFERENTIAL SUPPORT

BACKGROUND OF THE INVENTION

1. Field of the Invention

The invention relates generally to the design of packer devices in subterranean wells.

2. Description of the Related Art

Inflatable packers are used to create seals within tubular members in wells. An inflatable packer typically includes a flexible packer element that is inflated with fluid to cause the packer element to expand radially outwardly from a mandrel and into sealing contact with a surrounding tubular member. The packer element is typically formed of rubber or another elastomer and may be reinforced with flexible axially-extending ribs.

Inflatable packers may be prone to leakage of fluid or reduction in interior pressure over the long term which may undesirably unset the packer or lead to leakage across the packer.

SUMMARY OF THE INVENTION

The invention provides methods and devices for supporting an inflatable packer element with an interior swage that is selectively radially expandable from a reduced diameter condition to an enlarged diameter condition. In the enlarged diameter condition, the swage provides mechanical support for the packer element around substantially the complete or full interior circumference of the packer element. In some embodiments, the swage can be moved back from the enlarged diameter condition to the reduced diameter condition in order to unset the packer device.

In accordance with particular embodiments of the invention, the swage has opposing rows of arcuate segments. In embodiments, the segments have tapered edge portions and are preferably slidably interconnected with each other using a tongue-in-groove or similar arrangement. When the opposing rows of arcuate segments are axially compressed, they move radially outwardly, expanding the packer element into sealing contact with a surrounding tubular member and providing full mechanical circumferential support to the packer element.

The packer membrane can have a number of configurations. In one described embodiment, the packer element includes an elastomeric membrane. According to some embodiments, the packer membrane includes reinforcing metal ribs that are located radially within the elastomeric membrane. In a further exemplary embodiment, a second elastomeric membrane is located radially within the reinforcing ribs.

In still other embodiments, the packer element provides additional features that allow for improved sealing. According to particular embodiments, annular reinforcing ridges of the packer element are corrugated using either "U" or "V" shaped corrugations. Bonded elastomer is preferably used to cover the corrugated outer and inner surfaces.

A packer device in accordance with the present invention may be incorporated into a running string along with complimentary components, such as slip assemblies which will help secure the packer device in place within a surrounding tubular member. Also according to particular embodiments, a setting tool is incorporated into the running string along with the packer device which is capable of setting the packer device via shifting of a setting sleeve to axially compress and set the swage as well as neighboring devices, such as slip assemblies.

According to exemplary methods of operation, the packer device is incorporated into a running string and disposed into a surrounding tubular member or string. The packer device is then disposed to a desired location within the surrounding tubular member or string. Thereafter, the setting tool is actuated to cause the packer device to be set by moving the swage to its enlarged diameter condition, which urges the packer element into sealing contact with the surrounding tubular member. In some embodiments, the packer device can be later unset by moving the swage back to its reduced diameter condition, which permits the packer device to be removed from the surrounding tubular member.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
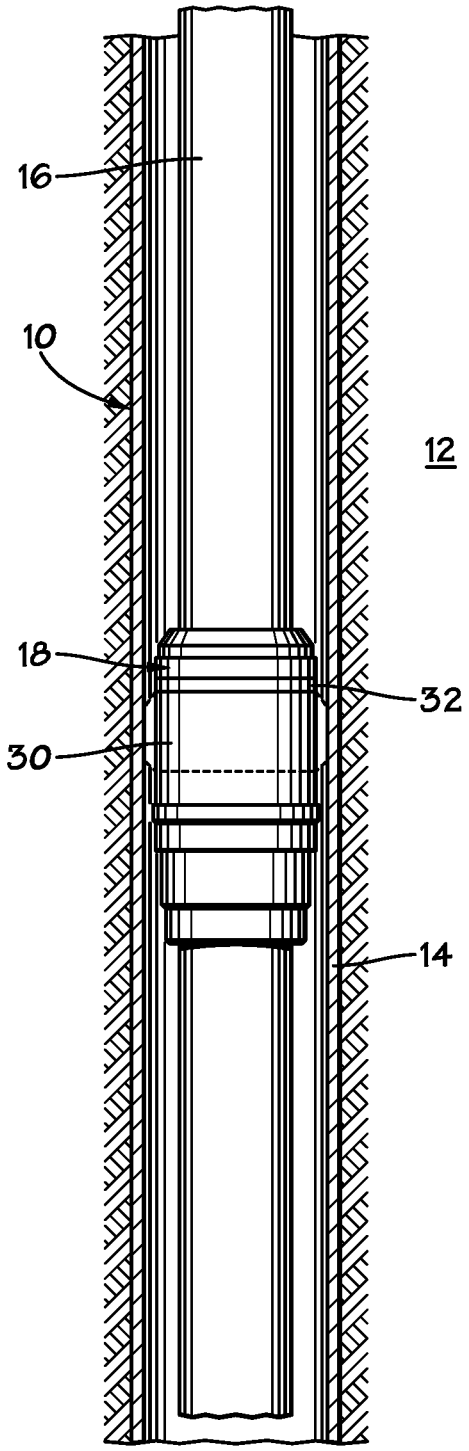
FIG. 1 is a side, partial cross-sectional view of an exemplary wellbore having a packer device constructed in accordance with the present invention.

FIG. 1 illustrates an exemplary wellbore 10 that has been formed in the earth 12. The wellbore 10 is lined with metallic casing 14. A running string 16 is shown disposed within the wellbore 10. The running string 16 may be made up of a string of production tubing segments or by coiled tubing, or in other ways known in the art.

A packer device 18, constructed in accordance with the present invention, is incorporated into the running string 16. In FIG. 1, the packer device 18 is shown in an unset condition so that it does not form a seal against the surrounding tubular casing 14. Dashed lines are used to depict the packer device 18 in a set position, so that a seal is formed against the casing 14.

Figure 2:
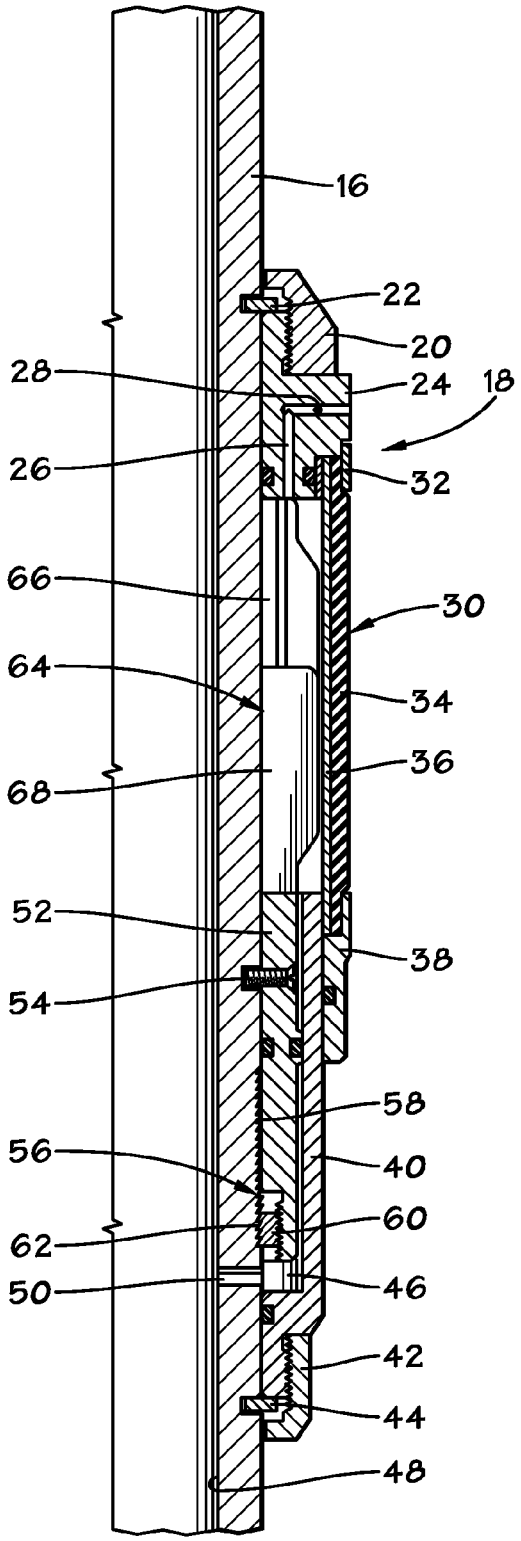
FIG. 2 is a side, one quarter-sectional view of portions of an exemplary packer device constructed in accordance with the present invention, in an unset position.
Figure 3:
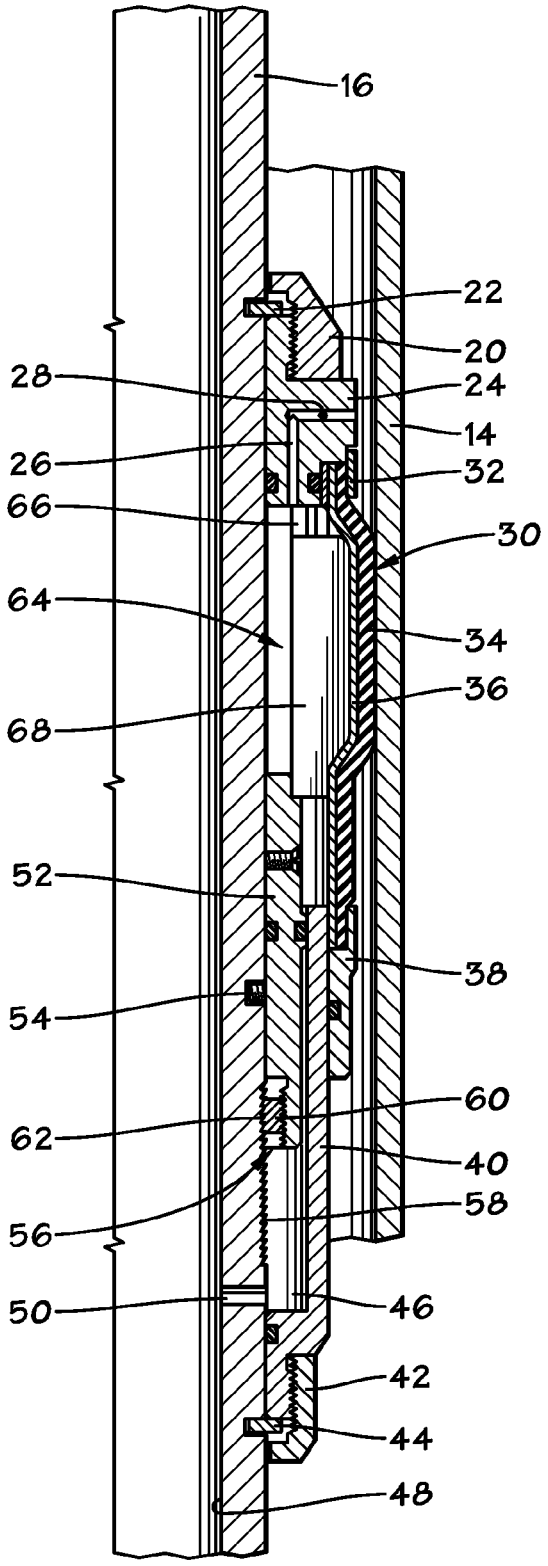
FIG. 3 is a side, one quarter-sectional view of the portions of the packer device shown in FIG. 2, now in a set condition.

FIGS. 2 and 3 illustrate an exemplary hydraulically-set packer device 18 in one-quarter side cross-section. Several of the drawings illustrate the use of fluid seals, such as annular elastomeric O-ring seals and the like. Since the use of such seals is well known in the art, these will not be discussed in any detail. In FIG. 2, the packer device 18 is in an unset condition, while FIG. 3 shows the packer device 18 set against the casing 14. The exemplary packer device 18 includes, at its upper end, a gage ring 20 that is axially secured to the running string 16 by an upper snap ring 22. The gage ring 20 is threadedly secured to a retainer ring 24. The retainer ring 24 preferably includes a fluid bleed passage 26 having a one-way check valve 28 therein of a type known in the art. The upper end of packer element 30 is secured between the retainer ring 24 and upper seal ring 32. In the embodiment shown in FIGS. 2 and 3, the packer element 30 is made up of an elastomeric membrane or sleeve 34 and supporting longitudinal ribs 36. The lower end of the packer element 30 is secured between lower seal ring 38 and annular cylinder 40. The cylinder 40 is threadedly affixed to cover ring 42, which is axially secured to the running string 16 via snap ring 44. The cylinder 40 surrounds the running string 16 and defines an enlarged-diameter interior chamber portion 46.

It is noted that, in the depicted embodiment, the running string 16 defines a central fluid flowbore 48 along its length which permits hydraulic fluid to be pumped down from the surface to the packer device 18. A fluid flow port 50 is provided through the running string 16 to permit fluid to be transmitted from the flowbore 48 into the interior chamber portion 46 of the cylinder 40.

An axially moveable annular piston 52 is disposed within the interior portion 46 of the cylinder 40 and is initially secured to the running string 16 by a frangible shear screw 54. In addition, the piston 52 is provided with a body lock ring assembly, generally shown at 56, that ensures one-way ratchet-type movement of the piston 52 with respect to the running string 16. Body lock ring assemblies are well known in the art. As depicted, the exemplary body lock ring assembly 56 includes a ratchet surface 58 that is formed on the outer radial surface of the running string 16 and a locking ring 60 that is loosely retained by the piston 52. The locking ring 60 presents an inwardly-facing ratchet surface 62 that is generally complimentary to the surface 58 of the running string 16. The body lock ring assembly 56 permits the piston 52 to be moved axially upwardly with respect to the running string 16, but prevents reverse movement of the piston 52.

Figure 5:
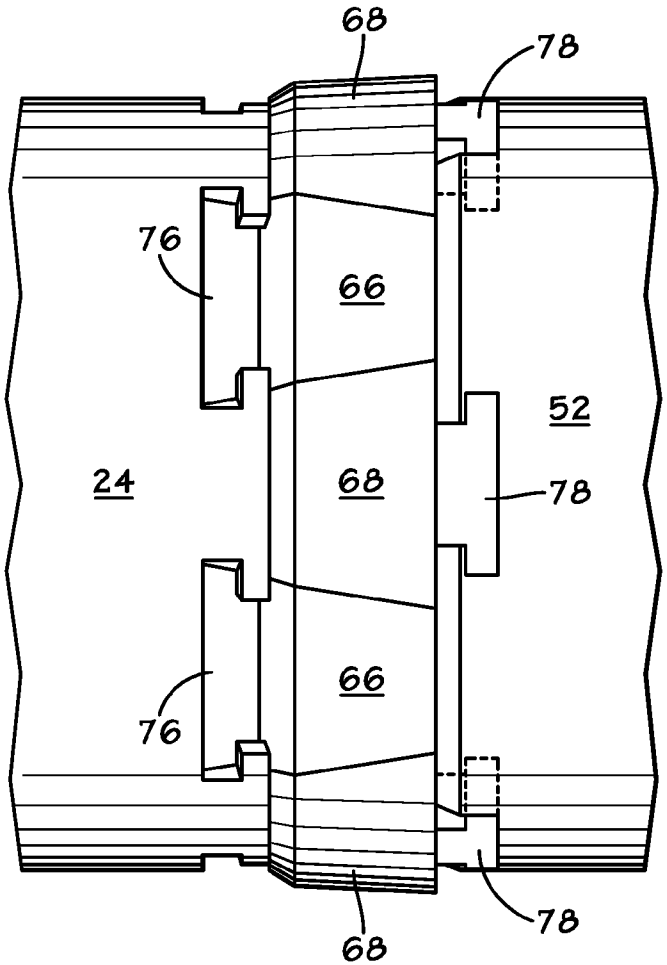
FIG. 5 is an isometric view of the swage and surrounding components shown in FIG. 4, now in an expanded diameter condition.

A radially expandable swage assembly, generally shown at 64, is located radially within the packer element 30 and radially outside of the running string 16. An exemplary swage assembly 64 is shown in greater detail in FIGS. 4 and 5. It is noted that features and aspects of similar radially expandable swage devices are described in U.S. Pat. No. 7,549,469 issued to Garcia. The Garcia patent is owned by the assignee of the present application and is herein incorporated by reference in its entirety. The exemplary swage assembly 64 includes first and second annular rows of wedge-shaped arcuate segments 66, 68 which overlap each other and are axially movable with respect to each other. The first and second rows of segments 66, 68 are moveable between a first, offset configuration (shown in FIGS. 2 and 4) and a second, generally aligned configuration (FIGS. 3 and 5). In the first configuration, the segments 66, 68 present an annular formation having a reduced diameter. In the second configuration, the segments 66, 68 present an annular formation having an enlarged diameter. FIG. 5 depicts the segments 66, 68 as being completely aligned with each other. However, those of skill in the art will understand that the segments 66, 68 may still be offset to some degree in the generally aligned position wherein the swage assembly 64 is set. Therefore, it is intended that, in the generally aligned configuration, the segments 66, 68 are more aligned than in the first, offset configuration, but need not be completely aligned. It is noted that the segments 66, 68 are each wedge shaped such that they present edge portions 70 that converge toward their distal ends 72. In the depicted embodiment, a tongue-and-groove arrangement, generally indicated at 74, is used to ensure that the segments 66, 68 remain slidably interconnected with one another.

Figure 4:
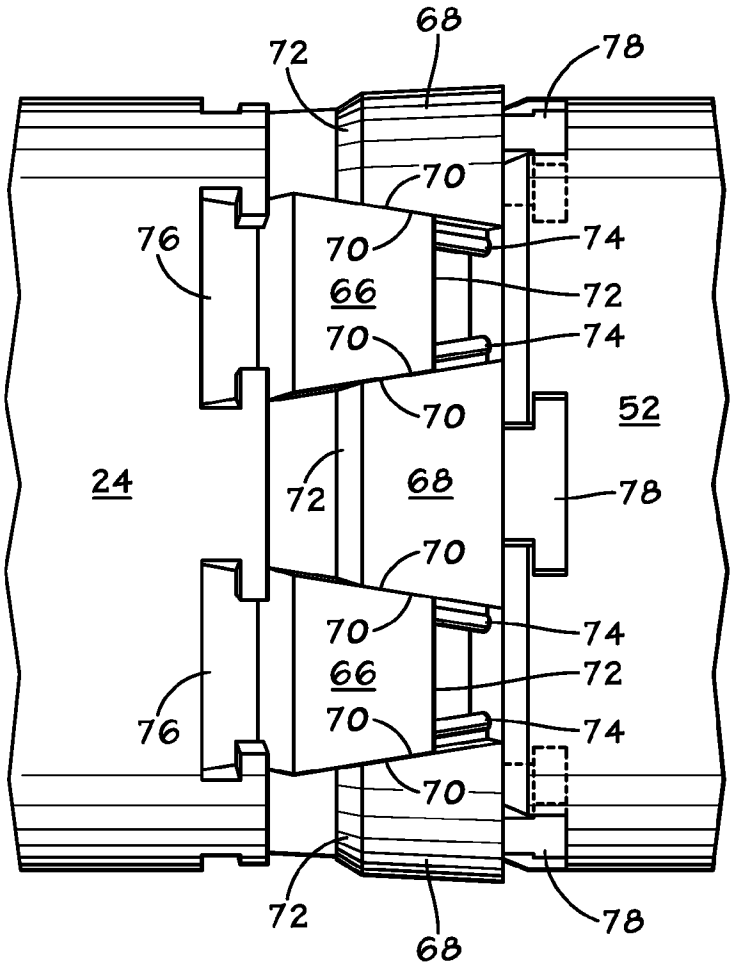
FIG. 4 is an isometric view of an exemplary swage and surrounding components with the packer element removed.

In the embodiment depicted in FIGS. 3 and 4, the proximal ends 76 of the first row of segments 66 are mechanically interlocked with the retainer ring 24. The proximal ends 78 of the second row of segments 68 are mechanically interlocked with the piston 52. The interlocking connections between the segments 66 and 68 and the ring 24 and piston 52 are preferably such that the segments 66, 68 are free to move radially outwardly relative to the ring 24 and piston 52.

In order to actuate the packer device 18, fluid pressure is increased within the flowbore 48 of the running string 16. Fluid flows into the chamber portion 46 via flow port 50. Fluid pressure will bear upon the lower end of piston 52 and urge it axially upwardly with respect to the running string 16, rupturing shear screw 54.

As the piston 52 is moved axially upwardly with respect to the running string 16, the swage assembly 64 is axially compressed between the retaining ring 24 and the piston 52. As is known with regard to the operation of certain swages, the segments 66, 68 are moved into general axial alignment with each other, as depicted in FIG. 5, causing the segments 66, 68 to move radially outwardly with respect to the inner running string 16. Radial outward movement of the segments 66, 68 will urge the surrounding packer element 30 into sealing engagement with the surrounding casing 14, as depicted in FIGS. 1 and 3.

Figure 6:
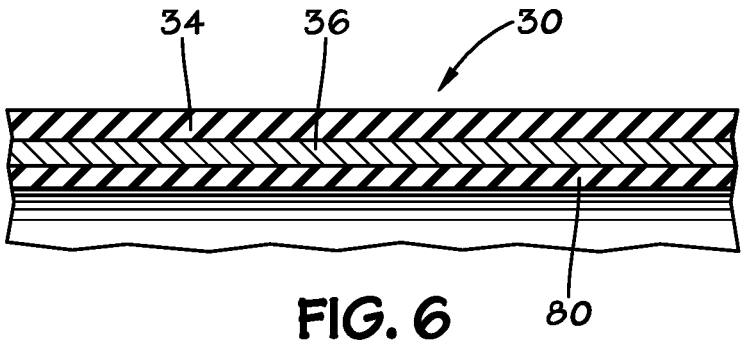
FIG. 6 is a cross-sectional view of an exemplary packer element that could be used with the packer device shown in FIGS. 2-3.

FIG. 6 is a cross-sectional view of an exemplary packer element 30 which might be used in the packer device 18. The packer element 30 includes an inner elastomeric sleeve 80. A layer of reinforcing ribs 38 radially surrounds the inner sleeve 80. An outer elastomeric sleeve 34 radially surrounds the layer of ribs 38.

Figure 7:
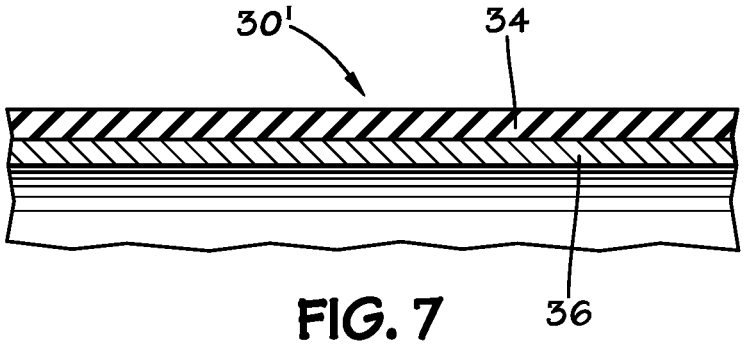
FIG. 7 is a cross-sectional view of an alternative exemplary packer element that could be used with the packer device shown in FIGS. 2-3.

FIG. 7 is a cross-sectional view of an alternative packer element 30' which could also be used with the packer device 18. The packer element 30' includes a layer of reinforcing ribs 38 and a surrounding elastomeric sleeve 34.

Figure 8:
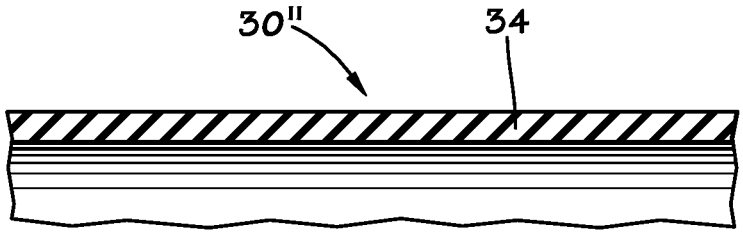
FIG. 8 is a cross-sectional view of a further alternative exemplary packer element that could be used with the packer device shown in FIGS. 2-3.

FIG. 8 is a cross-sectional view of a further alternative packer element 30" which also might be used with the packer device 18. In this embodiment, the packer element 30" consists of a single elastomeric sleeve 34.

Figure 9:
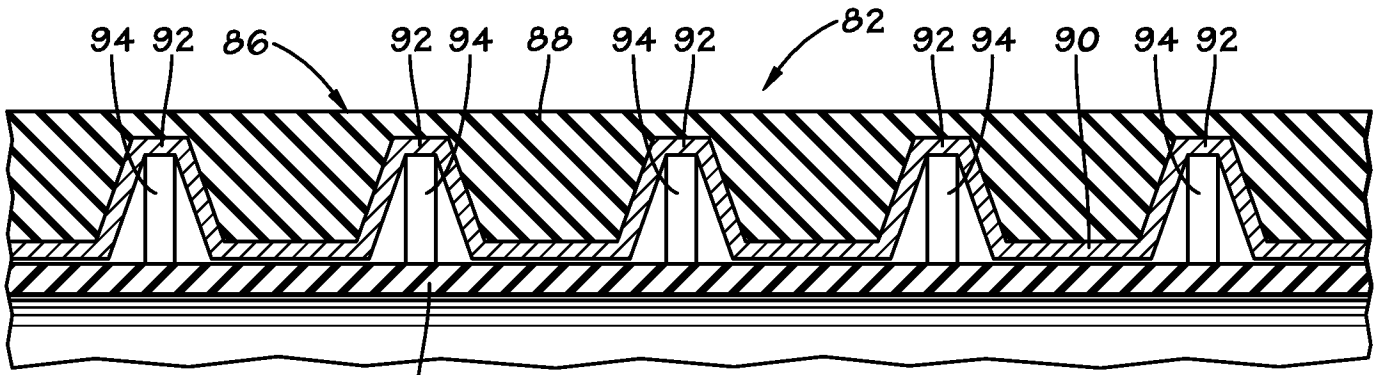
FIG. 9 is a cross-sectional view of an exemplary packer element that could be used with the packer device shown in FIGS. 2-3, including outer corrugated ridges.
Figure 9A:
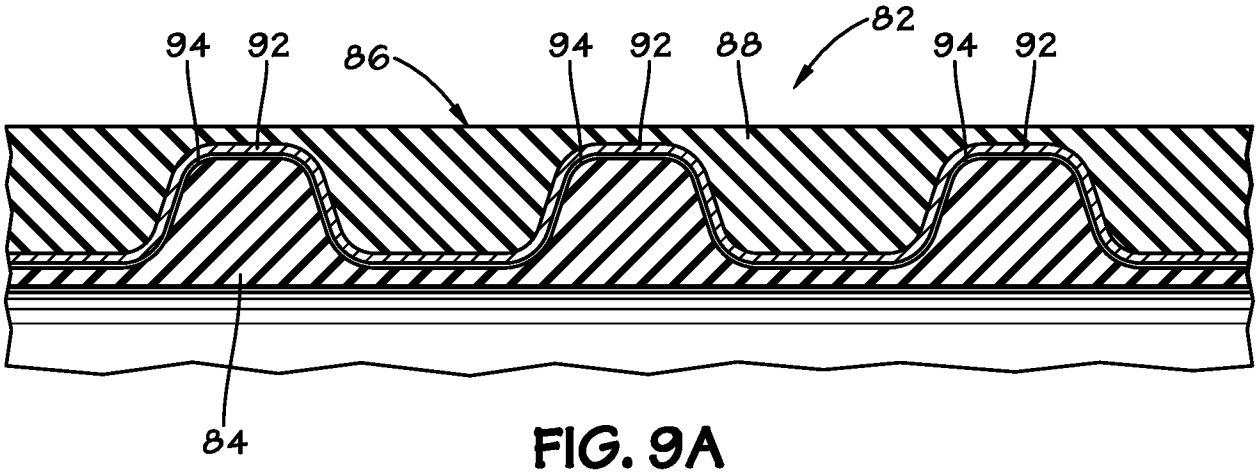
FIG. 9A is a cross-sectional view of the packer element shown in FIG. 9, now in a radially expanded condition.

FIG. 9 illustrates the outer surface of an alternative packer element 82, in accordance with the present invention, which includes an inner elastomeric sleeve 84 and an outer elastomeric carcass 86. The carcass 86 includes elastomer 88 that is molded onto a metallic sleeve 90. The metallic sleeve 90 contains generally U-shaped annular corrugations that form annular ridges 92. In one embodiment, the metallic sleeve 90 is a solid piece of cylindrical material which has corrugations machined into it. Alternatively, the corrugations could be formed in other ways known in the art. Voids 94 are located between the metallic sleeve 90 and the elastomeric sleeve 84. During sealing by expansion of the swage 64, the ridges 92 are expanded circumferentially and elastomer from the elastomeric sleeve 84 is urged into the voids 94. When the swage assembly 64 expands outwardly and presses the ridges 92 of the corrugations outwardly, the voids 94 will be filled with elastomeric material from the sleeve 84, as shown in FIG. 9A to provide resilient support for the ridges 92. Also as depicted in FIG. 9A, the elastomeric material 88 of the carcass 86 will thin. Also, the material making up the sleeve 90 may become thinner.

Figure 10:
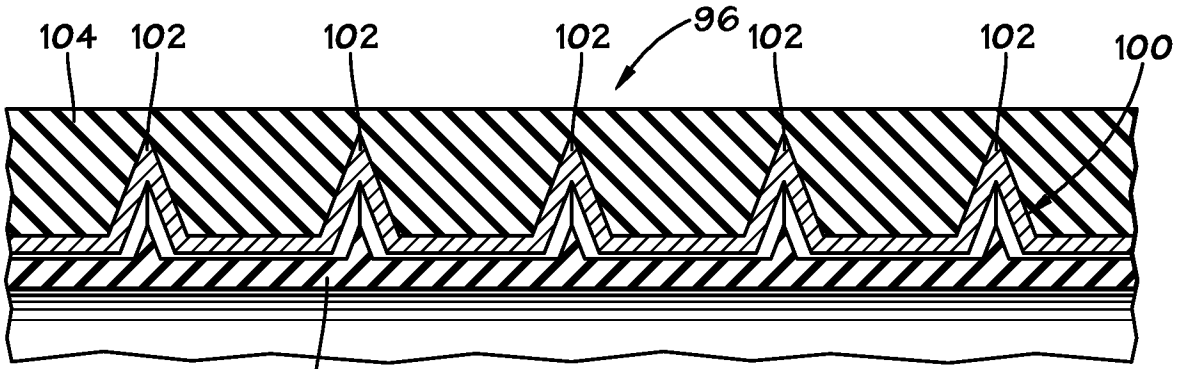
FIG. 10 is a cross-sectional view of a further exemplary packer element that could be used with the packer device of FIGS. 2-3, also including outer corrugated ridges.
Figure 10A:
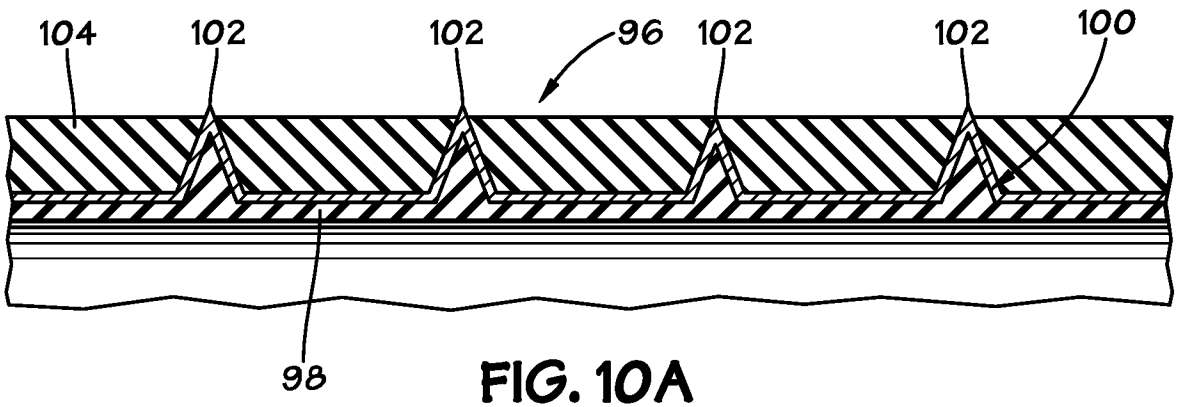
FIG. 10A is a cross-sectional view of the packer element shown in FIG. 10, now in a radially expanded condition.

FIG. 10 depicts the outer surface of a further alternative packer element 96 which includes an inner elastomeric sleeve 98 and an outer metallic sleeve 100. Generally V-shaped corrugations 102 are formed in the metallic sleeve 100. An outer elastomeric sleeve 104 is bonded to the metallic sleeve 100. FIG. 10A depicts the alternative packer element 96 in a set, radially expanded position. It can be seen that some or all of the end points of the corrugations 102 penetrate the outer elastomeric sleeve 104. The interior elastomeric material of the inner sleeve 98 provides resilient support for the corrugations 102.

In addition to its use in hydraulically-set packer devices, such as the packer device 18 described previously, packer devices constructed in accordance with the present invention may also be used within mechanically-set wireline-run assemblies, as are known in the art. In addition, packer devices constructed in accordance with the present invention may be incorporated into assemblies which also include one or more compression-set slip devices, of a type known in the art, to mechanically lock the packer device within a surrounding tubular member.

Those of skill in the art will understand that, while the exemplary packer device 30 is shown forming a seal with surrounding casing 14, the devices and methods of the present invention may be used with a variety of other surrounding tubular members, including liners and tubing members.

The foregoing description is directed to particular embodiments of the present invention for the purpose of illustration and explanation. It will be apparent, however, to those skilled in the art that many modifications and changes to the embodiment set forth above are possible without departing from the scope and the spirit of the invention.

What is claimed is:

1. A packer device for forming a fluid seal between an inner tubular member and an outer tubular member, the packer device comprising:

a swage assembly that is expandable from a reduced diameter condition to an expanded diameter condition;

a substantially deformable packer element for contacting and forming a fluid seal against a surrounding tubular, the packer element radially surrounding the swage assembly and being moved outwardly into a sealing configuration when the swage assembly is moved to its expanded diameter condition; and the swage assembly and packer element being secured to a running string that is used to dispose the swage assembly and packer element into a wellbore, the running string having a central fluid flowbore through which fluid is pumped to the packer device.

2. The packer device of claim 1 wherein the swage assembly comprises:

a first row of arcuate, wedge-shaped segments;

a second row of arcuate, wedge-shaped segments; and wherein the first and second rows of segments being moveable between a first, offset configuration wherein the first and second rows of segments present an annular formation having a reduced diameter, and a second, generally aligned configuration wherein the first and second rows of segments present an annular formation having an enlarged diameter.

3. The packer device of claim 2 wherein the swage assembly is secured to the running string by at least one snap ring.

4. The packer device of claim 3 wherein the neighboring segments are slidably interconnected by a tongue-in-groove arrangement.

5. The packer device of claim 1 wherein the packer element comprises an elastomeric sleeve.

6. The packer device of claim 5 wherein the packer element further comprises a layer of deformable, longitudinal ribs.

7. The packer device of claim 5 wherein the elastomeric sleeve radially surrounds a metallic sleeve.

8. The packer device of claim 7 further comprising elastomeric material on the interior of the metallic sleeve.

9. The packer device of claim 7 wherein the metallic sleeve has annular corrugations to form annular ridges.

10. A packer device for forming a fluid seal between an inner tubular member and an outer tubular member, the packer device comprising:

a swage assembly that is expandable from a reduced diameter condition to an expanded diameter condition, the swage assembly comprising:

a first row of arcuate, wedge-shaped segments;

a second row of arcuate, wedge-shaped segments;

wherein the first and second rows of segments being moveable between a first, offset configuration wherein the first and second rows of segments present an annular formation having a reduced diameter, and a second, generally aligned configuration wherein the first and second rows of segments present an annular formation having an enlarged diameter;

a substantially deformable packer element for contacting and forming a fluid seal against a surrounding tubular, the packer element radially surrounding the swage assembly and being moved outwardly into a sealing configuration when the swage assembly is moved to its expanded diameter condition; and the swage assembly and packer element being secured to a running string that is used to dispose the swage assembly and packer element into a wellbore, the running string having a central fluid flowbore through which fluid is pumped to the packer device.

11. The packer device of claim 10 wherein each of the segments of the swage assembly is slidably interconnected with a neighboring segment.

12. The packer device of claim 10 wherein the packer element comprises an elastomeric sleeve.

13. The packer device of claim 12 wherein the packer element further comprises a layer of deformable, longitudinal ribs.

14. The packer device of claim 12 wherein the packer element further comprises a metallic sleeve radially within the elastomeric sleeve.

15. The packer device of claim 14 wherein elastomeric material is located radially within the metallic sleeve.

16. The packer device of claim 14 wherein the metallic sleeve has annular corrugations to form annular ridges.

17. A method of forming a seal within a tubular member comprising the steps of:

disposing a packer device within the tubular member by a running string having a central fluid flowbore through which fluid is pumped to the packer device, the packer device comprising a swage assembly that is expandable from a reduced diameter condition to an expanded diameter condition and a substantially deformable packer element radially surrounding the swage assembly to contact and form a fluid seal against the tubular member;

transmitting fluid from the central fluid flowbore through the running string to axially compress the swage assembly to axially compress the swage assembly to move the swage assembly to the expanded diameter condition; and compression of the swage assembly causing the packer element to seal against the tubular member.

* * * * *